US010481528B2

(12) United States Patent
Takahashi et al.

(10) Patent No.: US 10,481,528 B2
(45) Date of Patent: Nov. 19, 2019

(54) IMAGE FORMING METHOD, IMAGE FORMING APPARATUS, AND TONER IMAGE FIXING APPARATUS

(71) Applicant: Konica Minolta, Inc., Tokyo (JP)

(72) Inventors: Seijiro Takahashi, Kokubunji (JP); Haruo Horiguchi, Koganei (JP); Toyoko Shibata, Tokyo (JP)

(73) Assignee: KONICA MINOLTA, INC., Tokyo (JP)

( * ) Notice: Subject to any disclaimer, the term of this patent is extended or adjusted under 35 U.S.C. 154(b) by 0 days.

(21) Appl. No.: 16/028,118

(22) Filed: Jul. 5, 2018

(65) Prior Publication Data

US 2019/0011858 A1 Jan. 10, 2019

(30) Foreign Application Priority Data

Jul. 10, 2017 (JP) ..... 2017-134685

(51) Int. Cl.

| | |
|---|---|
| ***G03G 15/16*** | (2006.01) |
| ***G03G 15/04*** | (2006.01) |
| ***G03G 9/087*** | (2006.01) |
| *G03G 15/20* | (2006.01) |

(52) U.S. Cl.

CPC ..... *G03G 15/16* (2013.01); *G03G 9/087* (2013.01); *G03G 15/04* (2013.01); *G03G 15/2039* (2013.01); *G03G 15/2064* (2013.01)

(58) Field of Classification Search

CPC .... G03G 15/16; G03G 15/04; G03G 15/2039; G03G 15/2064; G03G 9/087

See application file for complete search history.

(56) References Cited

U.S. PATENT DOCUMENTS

| | | | | |
|---|---|---|---|---|
| 6,594,465 | B2 | 7/2003 | Rohde et al. | |
| 2007/0207402 | A1* | 9/2007 | Takagi | G03G 9/08793 430/110.2 |
| 2008/0032225 | A1* | 2/2008 | Teshima | G03G 9/12 430/114 |
| 2010/0055602 | A1* | 3/2010 | Teshima | G03G 9/08755 430/114 |
| 2011/0020030 | A1* | 1/2011 | Mera | G03G 9/0812 399/111 |
| 2015/0093700 | A1* | 4/2015 | Momotani | G03G 9/131 430/114 |
| 2016/0011537 | A1* | 1/2016 | Higuchi | G03G 15/04045 399/177 |
| 2018/0217518 | A1* | 8/2018 | Takahashi | C09B 29/34 |

FOREIGN PATENT DOCUMENTS

| | | | |
|---|---|---|---|
| JP | 2002-304082 | A | 10/2002 |
| JP | 2007140177 | A * | 6/2007 |
| JP | 2010-128157 | A | 6/2010 |

OTHER PUBLICATIONS

Machine translation of JP 2007140177 A (Year: 2007).*

* cited by examiner

*Primary Examiner* — David J Bolduc
(74) *Attorney, Agent, or Firm* — Lucas & Mercanti, LLP

(57) ABSTRACT

An object of the present invention is achieved by an image forming method containing the steps of: forming a toner image by developing an electrostatic latent image with a toner; transferring the toner image on a recording medium; and fixing the toner image on the recording medium, wherein the fixing step of the toner image on the recording medium further contains the steps of: irradiating light having a wavelength range of 280 to 480 nm to the toner image; and applying pressure to the toner image.

15 Claims, 2 Drawing Sheets

IMAGE FORMING METHOD, IMAGE FORMING APPARATUS, AND TONER IMAGE FIXING APPARATUS

The entire disclosure of Japanese Patent Application No. 2017-134685, filed on Jul. 10, 2017 with Japan Patent Office, is incorporated herein by reference in its entirety.

TECHNOLOGICAL FIELD

The present invention relates to an image forming method, an image forming apparatus, and a toner image fixing apparatus. More specifically, the present invention relates to an image forming method in which a toner image fixed on a recording medium with a photo fixing system has excellent color reproducibility and sufficient fixing property.

BACKGROUND

In the past, in an electrophotographic process, a fixing system using light (hereafter it is called as "a photo fixing system" has been proposed in order to shorten operability (Warming-up time: WUT), to save energy, and to expand the types of recording media.

As a currently reported photo fixing system, a large number of systems for melting and fixing toner to the recording medium by converting light into heat have been proposed. Most of them are systems that melt and fix the toner by using light in the long wavelength range in the infrared region. On the other hand, light of a wavelength range of 480 nm or less (hereafter, it is referred to as "short wavelength range") has large energy and it is also absorbed by usually employed toner. Therefore, it is recognized that light in the short wavelength range may be suitably adopted as a means for irradiating light. According to Patent document 1 (JP-A 2002-304082) and Patent document 2 (JP-A 2010-128157), it is proposed that the toner image is fixed on a recording medium such as paper by irradiating the toner image with light in the short wavelength range from short visible region to UV (ultraviolet) region.

However, when fixing is performed only by irradiating light in a short wavelength range, there is a problem that color reproducibility is lowered and sufficient fixing property may not be obtained.

SUMMARY

The present invention has been made in view of the above-described problems and situation. An object of the present invention is to provide an image forming method in which a toner image fixed on a recording medium with a photo fixing system has excellent color reproducibility and sufficient fixing property, and also to provide an image forming apparatus using this method, as well as to provide a toner image fixing apparatus used in the image forming apparatus.

In order to achieve the above-described object of the present invention, the present invention was achieved. An aspect, of an image forming method of the present invention is a method containing the steps of: forming a toner image by developing an electrostatic latent image with a toner; transferring the toner image on a recording medium; and fixing the toner image on the recording medium, wherein the above-described fixing step of the toner image on the recording medium contains the steps of: irradiating light having a wavelength range of 280 to 480 nm to the toner image; and applying pressure to the toner image.

BRIEF DESCRIPTION OF THE DRAWINGS

The advantages and features provided by one or more embodiments of the invention will become more fully understood from the detailed description given hereinbelow and the appended drawings which are given by way of illustration only, and thus are not intended as a definition of the limits of the present invention.

DETAILED DESCRIPTION OF THE EMBODIMENTS

Figure 1:
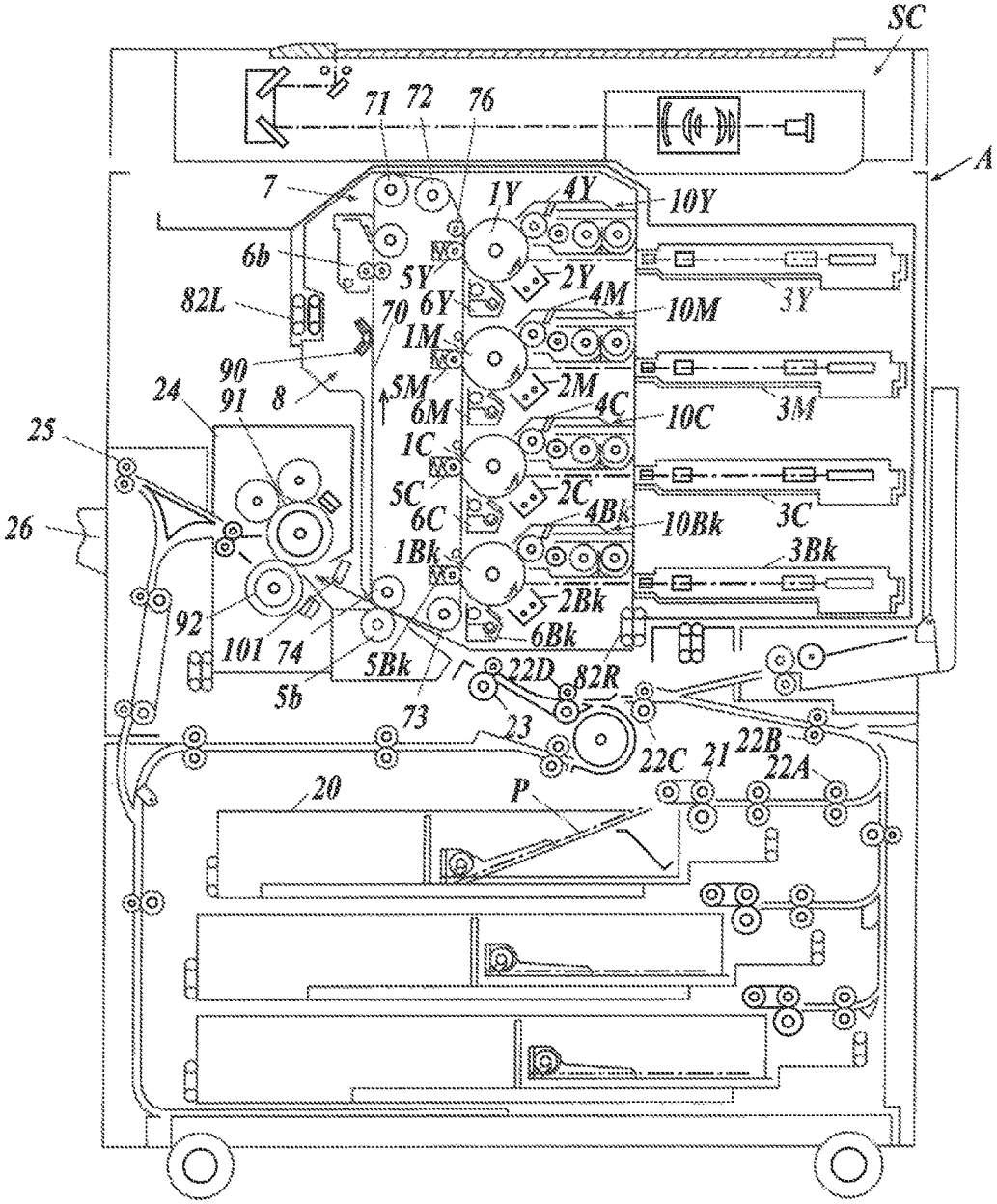
FIG. 1 is a schematic drawing illustrating an example of an image forming apparatus according to the present invention.

Hereinafter, one or more embodiments of the present invention will be described with reference to the drawings. However, the scope of the invention is not limited to the disclosed embodiments.

An image forming method of the present invention comprises the steps of: forming a toner image by developing an electrostatic latent image with a toner; transferring the toner image on a recording medium; and fixing the toner image on the recording medium. The image forming method of the present invention is characterized in having the fixing step of the toner image on the recording medium containing further steps of: irradiating light having a wavelength range of 280 to 480 nm to the toner image; and applying pressure to the toner image. The above-described technical feature is common to the inventions relating to the embodiments of the present invention. By this feature, the present invention enables to obtain a toner image fixed on a recording medium with a photo fixing system having excellent color reproducibility and sufficient fixing property.

An expression mechanism or an action mechanism of the effects of the present invention is not clearly identified, but it is supposed as follows.

A process of a photo fixing system is which a toner is fused and fixed on a recording medium by converting light into heat is carried out as follows (1) to (3).

(1) The toner image is irradiated with light in a wavelength range that may be absorbed by a compound contained in the toner image.

(2) The compound irradiated with light transits from the ground state to the excited state, then, it returns to the ground state by deactivation without radiation. At this time, thermal energy is released.

(3) By the thermal energy released in the above-described step (2), the surrounding resin softens and melts, thereby the toner image is fixed on the recording medium.

The amount of thermal energy to be released depends on the energy corresponding to the wavelength of the irradiated light and the absorbance of the compound which absorbs the light and the photostability of the compound. The smaller the wavelength of light, the greater the energy. The toner which is added with a coloring matter (colorant) is capable of absorbing light in a short wavelength range of 480 nm or less. Therefore, in the photo fixing system, irradiating light in a short wavelength range is considered to be effective.

However, in fact, when the toner image is fixed only by irradiating light in a short wavelength range, color reproducibility is decreased. The present inventors have investigated the reasons, and found out that there is a void inside of the fixed toner image.

Generally, light in a short wavelength range is easily scattered, and its diffraction angle is small. Therefore, when light is irradiated on the laminated toner image, the irradiated light is easily scattered at the interface of each layer. Consequently, the photo energy given to the deep portion on the laminated toner image becomes relatively smaller compared to the surface of the toner image. As a result, the void existing between the toner particles cannot be filled by melting of the toner, and air is enclosed inside of the toner image. Consequently, an amount of voids existing inside of the toner image becomes large, and it is considered that this causes a problem that the color reproducibility of the toner image after fixing is deteriorated, and sufficient fixability may not be obtained.

In order to solve the above-described problem, the present inventors conceived to incorporate a pressure applying step in addition to a light irradiating step in the toner image fixing step. Namely, by applying pressure to the toner image having been in a softened and melted state by light irradiation, air inside of the toner image may be pushed out, and deterioration of color reproducibility may be prevented. In addition, the transfer of heat released from the compound irradiated with light is promoted. As a result, sufficient fixability may be obtained. Thus, the present invention has been achieved.

When the toner image laminated with a plurality of toners is fixed, since the thermal energy produced by light irradiation varies for each color, uneven melting occurs and fixability is deteriorated. There is a need for improvement.

The image forming apparatus of the present invention promotes transfer of heat by applying pressure, it is possible to obtain excellent fixability even when an image having a plurality of colors is outputted.

A preferred embodiment of the present invention is that the toner image transferred on the recording medium is a black toner image or a color toner image formed with two or more color toners. The present invention enables to obtain a black toner image or a color toner image formed with two or more color toners exhibiting the above-described effect of the present invention.

A preferred embodiment of the present invention is that, in the light irradiating step, light having a wavelength range from 280 or more to less than 400 nm is irradiated. By this, it is possible to suitably obtain the effect of the present invention.

A preferred embodiment of the present invention is that, in the light irradiating step, light having a maximum emission wavelength range from 280 or more to less than 400 nm is irradiated. By this, it is possible to suitably obtain the effect of the present invention, and further to reduce energy consumption.

A preferred embodiment of the present invention is that, in the light irradiating step, light is irradiated with a light-emitting diode or a laser lighting source. By this, it is possible to suitably obtain the effect of the present invention, and to reduce energy consumption.

A preferred embodiment of the present invention is that, in the light irradiating step, a single or a plurality of lighting sources are used, and light is irradiated to the toner image transferred on the recording medium from all of the lighting sources regardless a maximum absorption wavelength of the toner contained in the toner image. The present invention enables to suitably obtain the effect of the present invention with the embodiment having the above-described configuration. The effect of the present invention may be obtained even with simpler control.

A preferred embodiment of the present invention is that, in the light irradiating step, light having a predetermined wavelength is irradiated to the toner image regardless a maximum absorption wavelength of the toner contained in the toner image. By irradiating light of a predetermined wavelength, it is possible to prevent the light irradiating unit from taking too much space in the image forming apparatus, and it is possible to avoid complicated control.

A preferred embodiment of the present invention is that, in the pressure applying step, the toner image transferred on the recording medium is pressed with a pressure in the range of 0.01 to 1.0 MPa. This makes it possible to push out the inside air suitably, and suitably promote transfer of heat. Further, it is preferable that the glossiness of the image is prevented from becoming too much.

A preferred embodiment of the present invention is that the toner contains a compound which absorbs light having a wavelength in the range of 280 to 480 nm. By this, it is possible to suitably obtain the effect of the present invention.

A preferred embodiment of the present invention is that the compound which absorbs light having a wavelength in the range of 280 to 480 nm is contained in the toner as a colorant. By this configuration, it is possible to suitably obtain the effect of the present invention.

A preferred embodiment of the present invention is that the pressure applying step is a step of heating the toner image transferred on the recording medium while applying pressure to the toner image transferred on the recording medium. By this, the fixability of the toner image is improved.

A preferred embodiment of the present invention is that, in the step of heating while applying pressure, a surface temperature of the toner image is heated to a temperature of $(T_{g\text{-}min}+20)°$ C. or more, provided that $T_{g\text{-}min}$ is a glass transition temperature of the toner having a lowest glass transition temperature among the toner which forms the toner image. By this, hot offset may be avoided, and it is possible to suitably obtain the effect of the present invention.

The image forming method of the present invention is suitably used for an image forming apparatus. The image forming apparatus may include: a toner image fixing apparatus containing a light irradiating unit to irradiate the toner image on the recording medium with light in a wavelength range of 280 to 480 nm; and a pressure applying unit.

By this, a decrease in color reproducibility is prevented, and it is possible to form an image having sufficient fixability.

The present invention and the constitution elements thereof, as well as configurations and embodiments, will be detailed in the following. In the present description, when two figures are used to indicate a range of value before and after "to", these figures are included in the range as a lowest limit value and an upper limit value.

«General Outline of Image Forming Method»

An image forming method of the present invention comprises the steps of: forming a toner image by developing an electrostatic latent image with a toner; transferring the toner image on a recording medium; and fixing the toner image on the recording medium. The image forming method of the present invention is characterized in having the fixing step of the toner image on the recording medium containing further steps of: irradiating light having a wavelength range of 280 to 480 nm to the toner image; and applying pressure to the toner image.

[About Each Step]

As each step described above, in addition to the image fixing step of the toner image on the recording medium (hereafter, it may be simply called as "fixing step"), other steps used for general electrophotographic image forming method (for example, charging step, electrostatic latent image forming step, developing step, transferring step, and cleaning step) are cited. The details of these steps will be described later. In the image forming method of the present invention, the other steps are not specifically limited as long as the toner image fixing step contains: light irradiating step with light having a wavelength range of 280 to 480 nm to the toner image; and pressure applying step to the toner image. The image may be formed with known steps within a range that does not impair the effect of the present invention.

In addition, the recording medium is not specifically limited. Known recording media may be used. Specific examples of the recording medium are: papers such as plain paper and coated paper, resins in the form of cloth or sheet, media that are capable of fixing a colorant adhered to the surface thereof.

[Fixing Step]

The fixing step according to the present invention contains at least: light irradiating step with light having a wavelength range of 280 to 480 nm to the toner image; and pressure applying step to the toner image.

[Light Irradiating Step]

In this step, light having a wavelength range of 280 to 480 nm is irradiated to the toner image transferred on the recording medium.

It is more preferable to irradiate the toner image with light having a wavelength range of 280 to 400 nm. The shorter the wavelength of light, the larger the energy per photon. However, light scattering becomes larger. Nevertheless, in the present invention, since the toner image fixing step contains the pressure applying step, it is possible to eliminate defects due to scattering. Therefore, even when light having a wavelength range of less than 400 nm (UV region) is irradiated, there is produced no problem caused by scattering. It is possible to suitably obtain the effect of the present invention. When the irradiated light has a wavelength of 280 nm or more, the resin contained in the toner image is not cleaved.

Further, in the light irradiating step, it is preferable to irradiate light having a maximum emission wavelength range from 280 or more to less than 400 nm. In the light irradiating step according to the present invention, the effect of the present invention is obtained by irradiating light having a wavelength range of 280 to 400 nm. When the irradiated light has a maximum emission wavelength range from 280 or more to less than 400 nm, the effect of the present invention is more effectively obtained. In addition, since power consumption may be reduced, this is a preferable embodiment.

In the light irradiating step, it is preferable to irradiate the toner image with light having a predetermined wavelength regardless a maximum absorption wavelength of the toner. By irradiating light of a predetermined wavelength, it is possible to prevent the light irradiating unit from taking too much space in the image forming apparatus, and it is possible to avoid complicated control.

In addition, "a maximum emission wavelength" of a light source designates an emission wavelength exhibiting the largest emission intensity among the local maximum valises of the emission peaks in the emission spectrum of the light source.

Further, "a maximum absorption wavelength" of the toner designates an absorption wavelength exhibiting the largest absorption intensity among the local maximum values of the absorption peaks (absorption bands) in the absorption spectrum of the toner.

<Irradiating Method of Light>

In the light irradiating step, the method for irradiating light is not specifically limited. Any method may be used as long as it is a method using a light source that enables to irradiate light having a wavelength range of 280 to 480 nm. For example, any known light source and method such as guiding light source with optical fiber may be used. In particular, it is preferable to irradiate with a light emitted from the light source such as a light-emitting diode or a laser lighting source. By using a light-emitting diode or a laser lighting source, photo-thermal conversion effect only due to light in the wavelength range of 280 to 480 nm may be obtained. As a result, the effect of the present invention is suitably obtained. In addition, since power consumption may be reduced, this is a preferable embodiment.

In the light irradiating step, the number of the light source is not specifically limited. In particular, in this step, it is preferable to use a single or a plurality of lighting sources, and to irradiate the toner image transferred on the recording medium from all of the lighting sources regardless a maximum absorption wavelength of the toner contained in the toner image. The light in the wavelength range of 280 to 480 nm according to the present invention is absorbed by a colorant (for example, cyan, magenta, yellow, black, and white). Therefore, even if light is simultaneously irradiated regardless of the number or difference in the wavelength range, the effect of the present invention may be obtained without problems. Consequently, even if a plurality of lighting sources are contained, all of light can be emitted from all of the light sources. As a result, the effect of the present invention may be obtained using a simple control without ON/OFF control for each light source.

[Pressure Applying Step]

In the pressure applying step, the toner image transferred on the recording medium is pressurized. Although the pressure applying step may be done before the light irradiating step, it is preferable to do after the light irradiating step. Because, applying pressure may be done to the toner already softened, and air in the toner image may be suitably pushed out.

<Pressure Applying Method>

The pressure applying method is not limited in particular as long as it has a configuration enabling to apply pressure to the toner image transferred on the recording medium. A specific example is a pressure applying method by using rollers of pressure applying members 91 and 92 contained in a pressure applying unit 9.

In this step, the toner image transferred on the recording medium is pressurized. Although the intensity of the pressurizing force of the toner image is not limited in particular, it is preferable to applying pressure to the toner image transferred on the recording medium with a pressure in the range of 0.01 to 1.0 MPa in the pressure applying step of the present invention. In this pressure applying step, preferable pressure to the toner image transferred on the recording medium is in the range of 0.01 to 1.0 MPa, and more preferable pressure is in the range of 0.05 to 0.8 MPa. By applying pressure in the above-described range, air inside of the toner may be suitably pushed out and transfer of heat may be suitably promoted. Specifically, by applying pressure with a pressure of 0.01 MPa or more, deformation amount of the toner may be sufficient, and air inside of the toner may be suitably pushed out. By applying pressure with a pressure of 1.0 MPa or less, it is possible to avoid the gloss of the image becomes too large.

<Heating Step with Applying Pressure>

The pressure applying step according to the present invention is preferably a heating step while applying pressure to the toner image transferred on the recording medium. The toner image that has been softened by irradiation with light is further softened by this heating. Consequently, fixability of the toner in the recording medium is further improved.

In addition, the method of heating with applying pressure is not limited in particular as long as it can heat the toner image transferred on the recording medium while applying pressure thereto. A specific example is a method in which the toner image is heated while applying pressure to the toner image by using pressure applying members 91 and 92 described later. They are rollers that can be heated.

(Heating Temperature)

In the heating step with applying pressure according to the present invention, it is preferable that a surface temperature of the toner image is heated to a temperature of $(T_{g\text{-}min}+20)°$ C. or more, provided that $T_{g\text{-}min}$, is a glass transition temperature of the toner having a lowest glass transition temperature among the toner which forms the toner image. More preferably, the surface temperature of the toner image is heated to a temperature of $(T_{g\text{-}min}+20)$ to $(T_{g\text{-}min}+100)°$ C. Still more preferably, the surface temperature of the toner image is heated to a temperature of $(T_{g\text{-}min}+25)$ to $(T_{g\text{-}min}+80)°°$ C. By heating the toner image in the above-described range, the effect may be more reliably obtained. When the temperature is $(T_{g\text{-}min}+20)°$ C. or more, it is possible to obtain the effect of applying pressure. When the temperature is $(T_{g\text{-}min}+100)°$ C. or less, it is possible to avoid hot offset. Hot offset is a phenomenon in which a portion of toner is transferred to a pressure applying member such as a roller in the fixing step, and toner layer is divided.

A glass transition temperature of toner may be measured with a differential scanning colorimetric apparatus "DSC 8500" (made by Perkin Elmer Co.).

A surface temperature of toner may be measured with a non-contact thermometric sensor. Specifically, a surface temperature of toner on the recording medium may be measured by setting the non-contact thermometric sensor at the place of discharging the recording medium from the heating member.

[Toner Image]

A toner image designates an image formed by developing an electrostatic latent image with a toner. In the present invention, it is preferable that the toner image transferred on the recording medium is a black toner image or a color toner image formed with two or more color toners. In addition, variations of color toner images are not limited is particular, the color image may be an image containing at least two kinds of colors selected from cyan, magenta, yellow and black. It may be a toner image composed of two color toners of black and white, and it may be a toner image composed of a plurality of color toners.

According to the present invention, the above-described effect may be suitably obtained from a black toner image or a color toner image formed with two or more color toners.

[Toner]

The toner according to the present invention is a toner used for development of an electrostatic latent image. The toner according to the present invention is constituted with toner particles.

In the present invention, "a toner" means an assembly of "toner particles".

<Compound Which Absorbs Light Having a Wavelength in the Range of 280 to 480 nm>

It is preferable that the toner according to the present invention contains a compound which absorbs light having a wavelength in the range of 280 to 480 nm. In particular, it is preferable that the toner according to the present invention contains a compound which has a local maximum absorption wavelength in the wavelength range of 280 to 480 nm. Such a compound has a relatively small influence on the hue of the toner, and a large amount of thermal energy may be extracted. Namely, in the present invention, by incorporating this compound in the toner image, hue and photo-thermal conversion may be suitably achieved. Consequently, the effect of the present invention may be suitably obtained.

The above-described compound is not limited in particular. For example, the colorants which are described later may be incorporated in the toner mother particles as a compound which absorbs light having a wavelength in the range of 280 to 480 nm. By using this configuration, the effect of the present invention may be suitably obtained by using the image forming method of the present invention.

<Toner Particles>

It is preferable that toner particles according to the present invention contain a binder resin including a thermoplastic resin and a compound that absorbs light in the range of 280 to 480 nm in the toner mother particles. A releasing agent may be contained in the toner particles when required.

Here, "toner mother particles" according to the present invention designate particles containing a binder resin and a colorant. Although the toner mother particles may be used as a toner as they are, in the present invention, the toner mother particle added with an external additive are preferably used as toner particles.

The production methods of the toner mother particles according to the present invention are not limited in particular. Usable methods are known methods such as: kneading pulverization method, suspension polymerization method, emulsion aggregation method, dissolution suspension method, polyester elongation method, and dispersion polymerization method.

<Colorant>

Toner mother particles according to the present invention may contain known colorants for yellow, magenta, cyan, and black. White colorant using inorganic particles such as titanium dioxide may also be used.

Specific examples of colorant are as described in the following. The following colorants are a compound that absorbs light in the range of 280 to 480 nm.

Examples of a colorant to obtain a black toner are: carbon black, a magnetic material, and iron-titanium complex oxide black. Examples of carbon black that may be used include: channel black, furnace black, acetylene black, thermal black, and lamp black. Examples of a magnetic material that may be used include: ferrite and magnetite.

Examples of a colorant to obtain a yellow toner are: dyes such as C.I. solvent yellow 19, C.I. solvent yellow 44, C.I. solvent yellow 77, C.I. solvent yellow 79, C.I. solvent yellow 81, C.I. solvent yellow 82, C.I. solvent yellow 93, C.I. solvent yellow 98, C.I. solvent yellow 103, C.I. solvent yellow 104, C.I. solvent yellow 112, C.I. and solvent yellow 162; and pigments such as C.I. pigment yellow 14, C.I. pigment yellow 17, C.I. pigment yellow 74, C.I. pigment yellow 93, C.I. pigment yellow 94, C.I. pigment yellow 138, C.I. pigment yellow 155, C.I. pigment yellow 180, and C.I. pigment yellow 185.

Examples of a colorant to obtain a magenta toner are: dyes such as C.I. solvent red 1, C.I. solvent red 49, C.I. solvent red 52, C.I. solvent red 58, C.I. solvent red 63, C.I. solvent red 111, and C.I. solvent red 122; and pigments such as C.I. pigment red 5, C.I. pigment red 48:1, C.I. pigment red 53:1, C.I. pigment red 57:1, C.I. pigment red 122, C.I. pigment red 123, C.I. pigment red 139, C.I. pigment red 144, C.I. pigment red 166, C.I. pigment red 177, C.I. pigment red 178, and C.I. pigment red 222.

Examples of a colorant to obtain a cyan toner are: dyes such as C.I. solvent blue 25, C.I. solvent blue 36, C.I. solvent blue 60, C.I. solvent blue 70, C.I. solvent blue 93, and C.I. solvent blue 95; and pigments such as C.I. pigment blue 1, C.I. pigment blue 7, C.I. pigment blue 15, C.I. pigment blue 60, C.I. pigment blue 62, C.I. pigment blue 66, C.I. pigment blue 76, C.I. pigment blue 76, and C.I. pigment blue 15:3.

Examples of a colorant to obtain a white toner are: inorganic pigments (for example, heavy calcium carbonate, light calcium carbonate, titanium dioxide, aluminum hydroxide, titanium white, talc, calcium sulfate, barium sulfate, zinc oxide, magnesium oxide, magnesium carbonate, amorphous silica, colloidal silica, white carbon, kaolin, calcined kaolin, laminated kaolin, aluminosilicate, sericite, bentonite, and smectite); and organic pigments (for example, polystyrene resin particles and urea formalin resin particles). Pigments having a hollow structure such as hollow resin particles and hollow silica may also be cited.

One kind of colorant or a combination of two or more kinds of colorants may be used to obtain each toner.

A content of the colorant in the toner with respect to the total mass of the toner is preferably in the range of 0.5 to 20 mass %, and more preferably in the range of 2 to 10 mass %.

<Binder Resin>

The toner according to the present invention may contain a binder resin. It is generally known that toner particles having almost uniform particle size and form may be produced by using an emulsion aggregation method as a production method of a toner.

In the toner according to the present invention, a generally used binder resin constituting a toner may be contained within a range of not inhibiting the effect of the present invention. A thermoplastic resin is cited as an example of this resin. Specific examples thereof are: styrene resin, acrylic resin, styrene-acrylic resin, polyester resin, silicone resin, olefin resin, amide resin, and epoxy resin. These binder resins may be used alone, or they may be used in combination of two or more kinds.

Among these resins, it is preferable to use at least one selected from the group consisting of styrene resin, acrylic resin, styrene-acrylic resin, and polyester resin from the viewpoint of becoming low viscosity when melted, and having a highly sharp melt property. It is more preferable to use at least one selected from the group consisting of styrene-acrylic resin and polyester resin.

A glass transition temperature ($T_g$) of a binder resin is preferably in the range of 30 to 70° C. from the viewpoint of fixability and heat-resisting storage property. More preferably, it is preferably in the range of 35 to 60° C. $T_g$ may be measure with differential scanning colorimetry.

<Releasing Agent>

The toner according to the present invention may contain a releasing agent. A usable releasing agent is not limited in particular. Various known waxes may be used. Examples of a wax are: low molecular weight polypropylene, polyethylene or oxidized low molecular weight polypropylene, polyolefin such as polyethylene, paraffin, and synthetic ester wax. It is particularly preferable to use a synthetic ester wax such as behenyl behenate, glycerin tribehenate, or pentaerythritol tetrabehenate.

A content ratio of a releasing agent is preferably in the range of 1 to 30 mass % in the toner, more preferably it is in the range of 3 to 15 mass %.

<Charge Control Agent>

The toner according to the present invention may contain a charge control agent. The used charge control agent is not limited in particular as long as it is a substance that is capable of providing positive or negative charge by a triboelectric charging, and colorless. Various known charge control agents that are positively chargeable or negatively chargeable may be used.

The content ratio of the charge control agent in the toner is preferably in the range of 0.1 to 30.0 mass %, and more preferably it is in the range of 0.1 to 10 mass %.

<External Additive>

In order to improve fluidity, charging property, and cleaning property of the toner, an external additive such as fluidity increasing agent and cleaning assisting agent may be added as an after treatment agent to constitute the toner of the present invention.

Examples of an external additive are: inorganic oxide particles such as silica particles, alumina particles, and titanium oxide particles; inorganic stearic acid compound particles such as aluminum stearate particles and zinc stearate particles; and inorganic particles of inorganic titanium acid compound particles such as strontium titanate particles and zinc titanate particles. These may be used alone, or they may be used in combination of two or more kinds.

From the viewpoint of improving heat-resisting storage stability and environmental stability, these inorganic particles may be subjected to a surface treatment by using a silane coupling agent, a titanium coupling agent, a higher aliphatic acid, or a silicone oil.

An added amount of the external additive in the toner is preferably in the range of 0.05 to 5 mass %. More preferably, it is in the range of 0.1 to 3 mass %.

<Particle Size of Toner Particles>

It is preferable that the toner particles of the present invention have an average particle size of 3 to 10 μm, more preferably 4 to 7 μm in volume-based median diameter ($D_{50}$). When the volume-based median diameter ($D_{50}$) is within the above-described range, the transfer efficiency is improved, the image quality of halftone is improved, and the image quality such as fine lines and dots is improved.

In the present invention, the volume-based median diameter ($D_{50}$) of the toner particles is measured and calculated by using measuring equipment composed of a "COULTER COUNTER 3" (Beckman Coulter Inc.) and a computer system installed with data processing software "Software V3.51" (Beckman Coulter Inc.) connected thereto.

In the measuring process, 0.02 g of sample to be measured (the toner particles) is blended in 20 mL of the surfactant solution (for the purpose of dispersing toner particles, for example, a surfactant solution in which a neutral detergent including a surfactant component is diluted by 10 times with pure water), ultrasonic dispersion is performed for 1 minute and a toner particle dispersion liquid is made. This toner particle dispersion liquid is poured into a beaker including ISOTON II (manufactured by Beckman Coulter, Inc.) in the sample stand with a pipette until the measurement concentration is 8 mass %.

By setting this content range, it is possible to obtain a reproducible measurement value. Then, the liquid is measured by setting the counter of the particle to be measured to 25,000. The aperture diameter is set to be 50 μm. The frequency count is calculated by dividing the range of the measurement range 1 to 30 μm by 256. The particle size where the accumulated volume counted from the largest size reaches 50% is determined as the volume-based median diameter ($D_{50}$).

[Other Processes]

The processes used in a general electrophotographic image forming method are described in the following. They are: charging process, electrostatic latent image forming process, developing process, fixing process, and cleaning process.

<Charging Process>

In this process, an electrophotographic photoreceptor is charged with electricity. A method of charging is not limited in particular. For example, a known charging roller method of conducting charging to the electrophotographic photoreceptor with a charging roller may be used.

<Electrostatic Latent Image Forming Process>

In this process, an electrostatic latent image is formed on the electrophotographic photoreceptor (electrostatic latent image carrier). Although the electrophotographic photoreceptor is not limited in particular, a drum shape photoreceptor made of organic photoreceptor such as polysilane or phthalopolymethine are usable.

Formation of an electrostatic latent image is performed as follows: a surface of the electrophotographic photoreceptor is uniformly charged with a charging device, then, the surface of the electrophotographic photoreceptor is image-wise exposed with an exposing device. Here, an electrostatic latent image is an image formed on the surface of the electrophotographic photoreceptor with the charging device.

The charging device and the exposing device are not limited in particular in the present invention. Generally used charging device and the exposing device in the electrophotographic method may be used.

<Developing Process>

A developing process is a process of forming a toner image by developing an electrostatic latent image with a toner (generally, a dry type developer containing a toner).

Formation of a toner image is carried out with a developing device composed of: a stirrer that charges the toner by friction stirring using a dry type developer containing a toner; and a rotatable magnet roller. Specifically, in the developing device, the toner and the carrier are mixed and stirred, and the toner is charged with electricity by friction. The charged toner is kept on the surface of a rotating magnetic roller to form a magnetic brush. Since the magnetic roller is disposed at a neighborhood of the electrophotographic photoreceptor, a part of the toner that constitutes the magnetic brush formed on the surface of a rotating magnetic roller is transferred by an electrical attraction force to the surface of the electrophotographic photoreceptor. As a result, the electrostatic latent image is developed with the toner and the toner image is formed on the surface of the electrophotographic photoreceptor.

<Transferring Process>

In this process, the toner image is transferred to a recording medium.

The transfer of the toner image on the recording medium is performed by peel charging the toner image on the recording medium.

As a transferring device, a corona transferring device with corona discharge, a transfer belt, and a transfer roller may be used.

The transferring process may be done in the following embodiment: by using an intermediate transferring member, the toner image is firstly transferred on the intermediate transferring member, then this toner image is secondary transferred on the recording medium. Another embodiment is to directly transfer the toner image formed on the electrophotographic photoreceptor on the recording medium.

<Cleaning Process>

In this process, the toner that is not used for image formation or the toner that is remained without being transferred is removed from the toner carrying member such as the photoreceptor or the intermediate transferring member.

The cleaning method is not limited in particular. It is preferable to use a method which uses a blade disposed to abut on the object to be cleaned such as the photoreceptor, and the tip of the blade scratches the photoreceptor.

«Image Forming Apparatus»

A generally used image forming apparatus may be used for an image forming apparatus of the present invention, provided that the above-described image forming method of the present invention is used for the present invention.

An example of an image forming apparatus of the present invention is described in the following.

FIG. 1 is a cross-sectional view that illustrates an example of configuration of an image forming apparatus of the present invention. An image forming apparatus illustrated in FIG. 1 is called as a tandem color image forming apparatus, and it includes four image forming units 10Y, 10M, 10C, and 10Bk, an intermediate transferring unit 7 having an endless belt form, a sheet feeding unit 21, and a toner image fixing apparatus 24. The image forming apparatus further includes a document scanner SC above a body A of the image forming apparatus.

The image forming unit 10Y forms a yellow image. The image forming unit 10Y includes a drum shape electrophotographic photoreceptor 1Y, with a charging unit 2Y, an exposing unit 3Y, a developing unit 4Y, and a cleaning unit 6Y located around the photoreceptor 1Y. The image forming unit 10Y further includes a primary transfer roller 5Y.

The image forming unit 10M forms a magenta image. The image forming unit 10M includes a drum shape electrophotographic photoreceptor 1M, with a charging unit 2M, an exposing unit 3M, a developing unit 4M, and a cleaning unit 6M located around the electrophotographic photoreceptor 1M. The image forming unit 10M further includes a primary transfer roller 5M.

The image forming unit 10C forms a cyan image. The image forming unit 10C includes a drum shape electrophotographic photoreceptor 1C, with a charging unit 2C, an exposing unit 3C, a developing unit 4C, and a cleaning unit 6C located around the electrophotographic photoreceptor 1C. The image forming unit 10C further includes a primary transfer roller 5C.

The image forming unit 10Bk forms a black image. The image forming unit 10 Bk includes a drum shape electrophotographic photoreceptor 1 Bk, with a charging unit 2 Bk, an exposing unit 3 Bk, a developing unit 4 Bk, and a cleaning unit 6 Bk located around the electrophotographic photoreceptor 1 Bk. The image forming unit 10 Bk further includes a primary transfer roller 5 Bk.

The image forming units 10Y, 10M, 10C, and 10Bk have the same configuration except for the colors of toner images formed on the electrophotographic photoreceptors 1Y, 1M, 1C, and 1Bk. Thus, the following description focuses on the image forming unit 10Y as an example.

In the present embodiment, in the image forming unit 10Y, at least the electrophotographic photoreceptor 1Y, the charging unit 2Y, the developing unit 4Y, and the cleaning unit 6Y are integrated.

The charging unit 2Y provides the electrophotographic photoreceptor 1Y with a uniform electric potential to charge the surface of the electrophotographic photoreceptor 1Y (for example, negatively charged). The charging unit 2Y may charge the surface of the electrophotographic photoreceptor 1Y by a non-contact charging method.

The exposing unit 3Y exposes the electrophotographic photoreceptor 1Y which has been given the uniform potential by the charging unit 2Y in response to image signals (yellow) to form an electrostatic latent image corresponding to the yellow image. The exposing unit 3Y includes light emitting devices (LEDs) arrayed in the axial direction of the electrophotographic photoreceptor 1Y and an imaging element (SELFOC (registered trade name)), or includes a laser optical device.

The developing unit 4Y forms a toner image by developing the electrostatic latent image which has been formed by the exposing unit 3Y with an electrostatic latent image developer. Although the electrostatic latent image developer is not specifically limited in the present invention, it is preferable to use a dry type developer.

In the image forming apparatus of FIG. 1, the electrophotographic photoreceptor 1Y, the charging unit 2Y, the exposing unit 3Y, the developing unit 4Y, and the cleaning unit 6Y are integrated as a process cartridge. This process cartridge may be detachably attached to the apparatus main body A. In addition, at least one of the charging unit 2Y, the exposing unit 3Y, the developing unit 4Y, transferring unit or separator unit, and the cleaning unit 6Y is integrally supported together with the electrophotographic photoreceptor 1Y to constitute a process cartridge. This process cartridge may be detachably attached to the apparatus main body A to form a single image forming unit (image forming unit). The single image forming unit may be detachably attached to the apparatus main body A using a guiding device such as a rail.

A housing 8 includes the image forming units 10Y, 10M, 10C, 10Bk, and the intermediate transferring unit 7. The housing 8 has a structure which may be drawn from the apparatus body A via rails 82L and 82R. In the housing 8, the image forming units 10Y, 10M, 10C, and 10Bk are arranged in cascade in the vertical direction. The intermediate transferring unit 7 is arranged in the left side of the photoreceptor 1Y, 1M, 1C, and 1Bk of FIG. 1. The intermediate transferring unit 7 contains: a rotatable endless belt type intermediate transfer belt 70 that is wound around rollers 71, 72, 73, and 74; first transfer rollers 5Y, 5M, 5C, and 5Bk; and a cleaning unit 6*b*.

In the following, an image forming method using an image forming apparatus illustrated in FIG. 1 will be described.

The color toner images formed in the image forming units 10Y, 10M, 10C, and 10Bk are sequentially transferred onto the rotating intermediate transferring member 70 with the respective first transferring rollers 5Y, 5M, 5C, and 5Bk, to form a synthesized color image on the intermediate transferring member 70.

A recording medium P (plain paper or transparent sheet) accommodated in a sheet feeding cassette 20 is fed by the sheet feeding unit 21, and it is transported to a second transferring roller 5*b* via multiple intermediate rollers 22A, 22B, 22C, and 22D and register rollers 23. The synthesized color image is transferred to the recording medium P by the second transferring roller 5*b*. Thus, a color image is transferred to the recording medium collectively. After secondary transferring the synthesized color image on the recording medium P, the endless belt type intermediate transfer belt 70 will separate the recording medium P by curvature. The recording medium P transferred with a color image is subjected to a fix treatment with the toner image fixing apparatus 24 (hereafter, it may be called as a fixing unit). The recording medium P is then pinched between discharging rollers 25 and it is conveyed to a sheet receiving tray 26 provided outside of the apparatus. After separation of the recording medium P from the intermediate transferring member 70, the residual toner on the intermediate transferring member 70 is removed by the cleaning unit 6*b*.

During image formation, the first transfer roller 5Bk continuously abuts the surface of the electrophotographic photoreceptor 1Bk. On the other hand, the first transfer rollers 5Y, 5M, and 5C abut the surface of the corresponding electrophotographic photoreceptors 1Y, 1M, and 1C only when a color image is formed. Further, the second transfer roller 5*b* abuts the surface of the endless belt type intermediate transferring member 70 only when the recording medium P passes and the second transfer is performed.

«Toner Image Fixing Apparatus»

A toner image fixing apparatus of the present invention is used for an image forming apparatus, and it contains: an irradiating unit with light having a wavelength of 280 to 480 nm; and a pressure applying unit.

Figure 2:
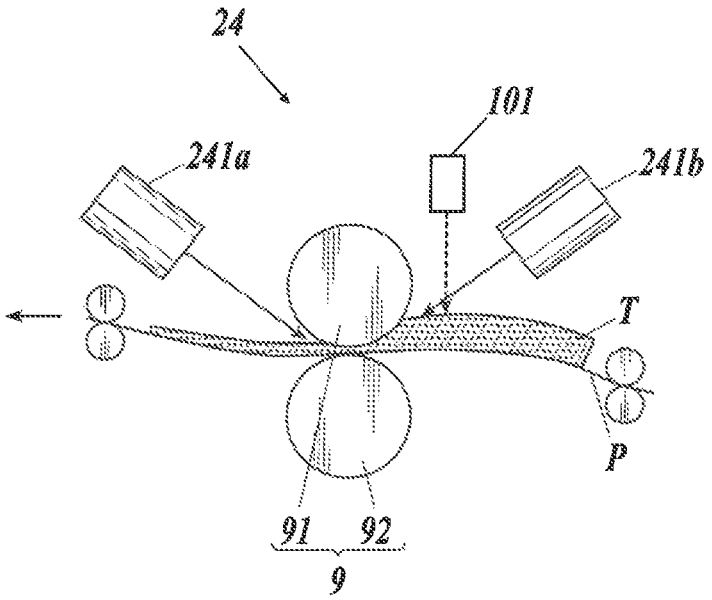
FIG. 2 is a schematic drawing enlarging a toner image fixing apparatus in an image forming apparatus of FIG. 1.

FIG. 2 is a schematic drawing enlarging a toner image fixing apparatus in an image forming apparatus illustrated in FIG. 1.

In an example illustrated in FIG. 2, a light irradiating unit 101 irradiates light to the toner image on the recording medium P. The light irradiating unit 101 is not limited in particular as long as it can irradiate light in the wavelength range of 2820 to 480 nm. A known light irradiating unit may be used. For example, a light emitting diode or a laser light source may be suitably used.

The light irradiating unit 101 is installed on the upstream side or the downstream side of the pressure applying unit 9 in the direction I in which the recording medium is conveyed.

The irradiation amount of light in the light irradiating unit 101 is preferably in the range of 0.1 to 200 J/cm$^2$, more preferably, in the range of 0.5 to 100 J/cm$^2$, and still more preferably, in the range of 1.0 to 50 J/cm$^2$.

<Pressure Applying Unit>

It is preferable that the pressure applying unit 9 has a configuration of conveying the toner image of the recording medium while applying pressure from above and below by rollers of pressure applying members 91 and 92. The pressure applying method is not limited in particular as long as it can pressurize the toner image. For example, it may have a configuration in which one of the pressure applying members 91 and 92 is fixed, and the toner image of the recording medium is pressurized by another pressure applying member.

It is preferable that the pressure applying members 91 and 92 are capable of heating the toner image of the recording medium P when the recording medium passes through the pressure applying members 91 and 92. The heating method is not limited in particular. A lamp type or an induction heating type heater may be incorporated in the pressure applying members 91 and 92. In this case, the fixing device may be provided with a thermometer to detect the temperature of the pressure applying members 91 and 92, and the heating temperature may be controlled based on the temperature measured with the thermometer.

By making the pressure applying members 91 and 92 to have the configuration as described above, it is possible to realize the heating process while applying pressure to the toner image on the recording medium. It is preferable to heat the surface temperature of the toner image to a temperature of ($T_{g\text{-}min}$+20)° C. or more, provided that $T_{g\text{-}min}$ is a glass transition temperature of the toner having a lowest glass transition temperature among the toner which forms the toner image.

The recording medium P conveyed to the fixing apparatus is subjected to light irradiation by the light irradiating unit 101 and the pressure applying unit 9, then, it is conveyed to the sheet receiving tray 26.

The embodiments to which the present invention may be applied are not limited to the above-described embodiments. They may be appropriately changed without departing from the essence of the present invention.

Although the embodiments of the present invention have been described and illustrated in detail, the disclosed embodiments are made for purpose of illustration and example only and not limitation. The scope of the present invention should be interpreted by terms of the appended claims.

EXAMPLES

Hereafter, the present invention will be described by referring to specific examples, but the present invention is not limited thereto. In the present examples, the description of "parts" or "%" is used, it represents "mass parts" or "mass %" unless specific notice is given.

«Production of Black Developer»

[Production of Black Toner]

<Preparation of Dispersion Liquid of Styrene-Acrylic Resin Particles 1>

(First Step Polymerization)

Into a reaction vessel equipped with a stirrer, a temperature sensor, a cooling tube and a nitrogen introducing device, a solution containing 8 mass parts of sodium dodecyl sulfate dissolved in 3,000 mass parts of ion-exchanged water was charged. While stirring at a stirring speed of 230 rpm under a nitrogen flow, the inner temperature of the reaction vessel was raised to 80° C.

After the temperature was raised, a solution of 10 mass parts of potassium persulfate dissolved in 200 mass parts of ion-exchanged water was added thereto, and the liquid temperature was raised again to 80° C. To this heated solution was dropwise added a polymerizable monomer mixture 1 composed of the following over 1 hour.

(Monomer Mixture 1)

Styrene: 480 mass parts;

n-Butyl acrylate: 250 mass parts;

Methacrylic acid: 68.0 mass parts; and n-Octyl-3-mercaptopropionate 16.0 mass parts Then, the reaction system was heated and stirred at 80° C. for 2 hours to carry out the polymerization. A dispersion liquid of styrene-acrylic resin particles (1A) was thus prepared. This dispersion liquid contains styrene-acrylic resin particles (1a).

(Second Step Polymerization)

Into a reaction vessel equipped with a stirrer, a temperature sensor, a cooling tube and a nitrogen introducing device, a solution of 7 mass parts of sodium polyoxyethylene-2-dodecyl ether sulfate dissolved in 800 mass parts of ion-exchanged water was charged. After heating the solution to 98° C., 260 mass parts of the dispersion liquid of styrene-acrylic resin particles (1A), and a monomer mixture 2 composed of the following with a releasing agent paraffin wax dissolved at 90° C. were added.

(Monomer Mixture 2)

Styrene: 245 mass parts;

n-Butyl acrylate: 120 mass parts;

n-Octyl-3-mercaptopropionate; 1.5 mass parts; and

Paraffin wax "HNP-11" (made of Nippon Seiro, Co. Ltd.): 67 mass parts.

The reaction system was mixed and dispersed for 1 hour by using a mechanical disperser with a circulation route "CLEARMIX" (M Technique Co., Ltd.) so that a dispersion liquid containing emulsion particles (oil particles) was prepared.

Then, an initiator solution of 6 mass parts of potassium persulfate dissolved in 200 mass parts of ion-exchanged water was added to the dispersion liquid, and the system was heated and stirred at 82° C. for 1 hour to carry out polymerization. A dispersion liquid of styrene-acrylic resin particles (1B) was thus prepared. This dispersion liquid contains styrene-acrylic resin particles (1b).

(Third Step Polymerization)

A solution of 11 mass parts of potassium persulfate dissolved in 400 mass parts of ion-exchanged water was added to the dispersion liquid of styrene-acrylic resin particles (1B) was added. Then, a monomer mixture 3 composed of the following was added dropwise thereto at a temperature of 82° C. over 1 hour. During addition of the monomer mixture 3, the temperature of the dispersion liquid was kept to be 82° C.

(Monomer Mixture 3)

Styrene: 435 mass parts;

n-Butyl acrylate: 130 mass parts;

Methacrylic acid: 33 mass parts; and n-Octyl-3-mercapto propionate: 8 mass parts.

After the addition, the system was heated and stirred for 2 hours to carry out the polymerization. After performing polymerization, the system was cooled to 28° C. A dispersion liquid of styrene-acrylic resin particles (1) was thus prepared. This dispersion liquid contains styrene-acrylic resin (1).

A particle size of the styrene-acrylic resin particles in the dispersion liquid of styrene-acrylic resin particles (1) was measured with "Microtrac UPA-150" (made by Nikkiso Co., Ltd.) by using a dynamic light scattering method. The particle size was 120 nm in a volume-based median diameter. This styrene-acrylic resin (1) had a glass transition temperature ($T_g$) of 45° C.

The measurement of the glass transition temperature the styrene-acrylic resin (1) was done based on the measuring method for a glass transition temperature described later, and the sample to be measured was the styrene-acrylic resin (1).

<Preparation of Carbon Black Dispersion Liquid>

11.5 mass parts of sodium n-dodecyl sulfate were dissolved in 1,600 mass parts of pure water. To this solution ware gradually added 25 mass parts of carbon black "MOGUL L" (made of Cabot, Co. Ltd.). Then, the dispersion liquid was dispersed with a stirrer "CLEARMIX™ CLM-0.8S" (made by M Technique Co., Ltd.) to prepare a carbon black dispersion liquid. A particle size of the carbon black particles in the carbon black dispersion liquid was measure with an electrophoretic light scattering spectrometer "ELS-800" (Otsuka Electronics, Co. Ltd.). The number-based median diameter of the carbon black particles was 118 nm. When the absorption spectrum of the carbon black dispersion liquid was measured with a UV-Visible spectrophotometer "V-530" (made by JASCO Co. Ltd.), it was found that a colorant "MOGUL L" is a compound that absorbs light in the range of 280 to 480 nm.

<Aggregation and Fusing>

Into a reaction vessel equipped with a stirrer, a temperature sensor, and a cooling tube were loaded 504 mass parts (in solid fraction) of the above-prepared dispersion liquid of styrene-acrylic resin (1), 900 mass parts of ion-exchanged water, and 70 mass parts (in solid fraction) of carbon black dispersion liquid. While the inner temperature of the vessel was kept to be 30° C., a 5 mol/L sodium hydroxide aqueous solution was added in the vessel to adjust the pH to be 10.

Subsequently, an aqueous solution of 2 mass parts of magnesium chloride hexahydrate dissolved in 1,000 mass parts of ion-exchanged water was prepared. To the liquid in the vessel was added this aqueous solution over a period of 10 minutes. The addition of the aqueous solution was done while stirring the liquid in the vessel. After addition of the aqueous solution, rising of the temperature was started, and the temperature of the system was raised to 70° C. over a period of 60 minutes, and the temperature was held at 70° C. to allow the particle growth reaction to continue. While keeping this condition, the particle size of the aggregated particles was measured by using a "Multisizer 3" (Beckman Coulter, Inc.). When the volume-based median particle size ($D_{50}$) reached 6.5 μm, an aqueous solution of 190 mass parts of sodium chloride dissolved in 760 mass parts of ion-exchanged water was added to terminate the particle growth. Then, the liquid in the vessel was further kept at 70° C. and stirred over one hour. Then, the temperature of the liquid in the vessel was further increased to 75° C. Subsequently, by stirring the liquid in the vessel while keeping the temperature at 75° C., fusion of the particles was allowed to proceed. Then, the liquid in the vessel was cooled to 30° C. Thus, a dispersion liquid of toner particles was obtained.

The obtained dispersion liquid of toner particles was subjected to a solid-liquid separation treatment with a centrifugal separator. Thus a wet cake of toner particles was formed. The wet cake was washed with ion-exchanged water at 35° C. using the centrifugal separator until the state of achieving the electric conductivity of the filtrate to be 5 μS/cm. Then, the solid was transferred in "Flush Jet dryer" (made by Seishin Enterprise, Co. Ltd.), and it was dried until the state of achieving the content of water to be 0.5 mass %. Thus, black toner mother particles were obtained.

To the obtained toner mother particles were added external additives of 1 mass % of hydrophobic silica (number average primary particle diameter=12 nm) and 0.3 mass % of hydrophobic titanium oxide (number average primary particle diameter=20 nm). The mixture was blended by using a "Henschel mixer". Thus, a black toner having a glass transition temperature of 45° C., and a volume-based median diameter of 6.4 μm was obtained.

(Measuring Method of Glass Transition Temperature)

A glass transition temperature was measured with a differential scanning colorimetric apparatus "DSC 8500" (made by Perkin Elmer Co.).

Specifically, 4.5 mg of sample was weighed precisely down to two decimal places. Then the sample was sealed in an aluminum pan, and the sample is set in a sample holder "DSC-7". An empty aluminum pan was used for reference, temperature was controlled by Heat-Cool-Heat at a measured temperature being within a range of 0 to 200° C., temperature raising speed being 10° C. per minute, temperature lowering speed being 10° C. The analysis was performed based on data when the temperature is raised at the second Heat time. The glass transition temperature was determined as a value of the crossing point between the extended line of the base line before the rising of the first endothermic peak and the tangent showing the maximum slope from the rising portion of the first endothermic peak to the top of the peak.

[Production of Black Developer]

A ferrite carrier covered with a copolymer resin made of cyclohexyl methacrylate and methyl methacrylate (monomer mass ration=1:1) and having a volume-based average particle diameter of 30 μm was added to the black toners so that the content of the black toner became to be 6 mass %. Thus, a developer was prepared, and it was used for the following evaluations. A V-type mixer was used as a mixer and the mixture was blended for 30 minutes.

«Production of Yellow Toner and Yellow Developer»

A yellow toner having a glass transition temperature of 47° C., and a volume-based median diameter of 6.2 μm was produced in the same way as production of the black toner, except that C.I. Pigment Yellow 74 was used as a colorant instead of carbon black. A yellow developer was produced in the same way as production of the black developer.

An absorption spectrum of C.I. Pigment Yellow 74 was measured in the same was as done for a colorant "MOGUL L" contained in the black toner. It was found that C.I. Pigment Yellow 74 was a compound that absorbs light in the range of 280 to 480 nm.

«Production of Magenta Toner and Magenta Developer»

A magenta toner having a glass transition temperature of 45° C., and a volume-based median diameter of 6.1 μm was produced in the same way as production of the black toner, except that C.I. Pigment Red 122 was used as a colorant instead of carbon black. A magenta developer was produced in the same way as production of the black developer.

An absorption spectrum of C.I. Pigment Red 122 was measured in the same was as done for a colorant "MOGUL L" contained in the black toner. It was found that C.I. Pigment Red 122 was a compound that absorbs light in the range of 280 to 480 nm.

«Production of Cyan Toner and Cyan Developer»

A cyan toner having a glass transition temperature of 46° C., and a volume-based median diameter of 6.3 μm was produced in the same way as production of the black toner, except that C.I. Pigment Blue 15:3 was used as a colorant instead of carbon black. A cyan developer was produced in the same way as production of the black developer.

An absorption spectrum of C.I. Pigment Blue 15:3 was measured in the same was as done for a colorant "MOGUL L" contained in the black toner. It was found that C.I. Pigment Blue 15:3 was a compound that absorbs light in the range of 280 to 480 nm.

TABLE 1

| | Mass ratio of each toner constituting the toner image per unit area (%) | | | | Light irradiating step | Pressure applying step | | | |
|---|---|---|---|---|---|---|---|---|---|
| | Yellow toner | Magenta toner | Cyan toner | Black toner | Maximum emission wavelength (nm) | Pressurizing force (MPa) | Presence or absence of heating device | $T_{g\text{-}min}$ (° C.) | $T_{g\text{-}min}$ + 20 (° C.) |
| Example 1 | 0 | 0 | 0 | 100 | 365 | 0.3 | None | 45 | 65 |
| Example 2 | 0 | 0 | 0 | 100 | 385 | 0.3 | None | 45 | 65 |
| Example 3 | 0 | 0 | 0 | 100 | 405 | 0.3 | None | 45 | 65 |
| Example 4 | 0 | 0 | 0 | 100 | 365 | 0.005 | None | 45 | 65 |
| Example 5 | 0 | 0 | 0 | 100 | 365 | 0.8 | None | 45 | 65 |
| Example 6 | 0 | 0 | 0 | 100 | 365 | 2.5 | None | 45 | 65 |
| Example 7 | 0 | 0 | 0 | 100 | 365 | 0.3 | Present | 45 | 65 |
| Example 8 | 0 | 0 | 0 | 100 | 365 | 0.3 | Present | 45 | 65 |
| Example 9 | 0 | 0 | 0 | 100 | 365 | 0.3 | Present | 45 | 65 |
| Example 10 | 50 | 50 | 0 | 0 | 365 | 0.3 | None | 45 | 65 |
| Example 11 | 50 | 0 | 50 | 0 | 365 | 0.3 | None | 46 | 66 |
| Example 12 | 50 | 0 | 50 | 0 | 365 | 0.3 | Present | 46 | 66 |
| Example 13 | 40 | 30 | 30 | 0 | 365 | 0.3 | None | 45 | 65 |
| Example 14 | 25 | 25 | 25 | 25 | 365 | 0.3 | None | 45 | 65 |
| Example 15 | 25 | 25 | 25 | 25 | 405 | 0.3 | None | 45 | 65 |
| Example 16 | 25 | 25 | 25 | 25 | 365 | 0.3 | Present | 45 | 65 |
| Comparative example 1 | 0 | 0 | 0 | 100 | 365 | None | None | 45 | 65 |

| | Toner surface temperature (° C.) | $T_{g\text{-}min}$ + 80 (° C.) | Evaluation result of Color reproducibility | Evaluation result of Fixability (%) | Remarks |
|---|---|---|---|---|---|
| Example 1 | 105 | 125 | ◎ | 95 | Present invention |
| Example 1 | 107 | 125 | ◎ | 92 | Present invention |
| Example 1 | 105 | 125 | ◎ | 88 | Present invention |
| Example 1 | 105 | 125 | ○ | 82 | Present invention |
| Example 1 | 107 | 125 | ◎ | 96 | Present invention |
| Example 1 | 106 | 125 | ◎ (※1) | 94 | Present invention |
| Example 1 | 108 | 125 | ◎ | 97 | Present invention |
| Example 1 | 85 | 125 | ◎ | 91 | Present invention |
| Example 1 | 125 | 125 | ◎ | 98 | Present invention |
| Example 10 | 106 | 125 | ○ | 82 | Present invention |
| Example 11 | 103 | 126 | ◎ | 85 | Present invention |
| Example 12 | 107 | 126 | ◎ | 93 | Present invention |
| Example 13 | 103 | 125 | ○ | 83 | Present invention |
| Example 14 | 104 | 125 | ◎ | 91 | Present invention |
| Example 15 | 105 | 125 | ◎ | 88 | Present invention |
| Example 16 | 108 | 125 | ◎ | 97 | Present invention |
| Comparative example 1 | 103 | 125 | X | 75 | Comparative example |

(※1) Although Example 6 had large glossiness, the color reproducibility and the fixability thereof had no problem for practical use.

[Evaluation Methods]

The following evaluations each were performed by using a modified image forming apparatus "bizhub PRO™C6501" (made by Konica Minolta, Inc.). The fixing device thereof was modified and the developers as obtained above were evaluated under the normal temperature and normal humidity environment (temperature 20° C. and humidity 50% RH).

In Examples 1 to 16 and Comparative example 1, the fixing conditions of the toner image on the recording medium (maximum emission wavelength of irradiation light; presence or absence of pressure applying step; intensity of pressurizing force applied to the image on the recording medium; presence or absence of heating step; surface temperature of the toner image) were made as described in Table 1. The following items were evaluated.

In each Example and Comparative example, the irradiation light was obtained from an LED light source that emits light in the range of a maximum emission wavelength ±20 nm, and irradiation was done with the intensity of 10 J/cm$^2$.

As a pressure applying unit and a heating unit, a pressure applying unit 9 illustrated in FIG. 1 and FIG. 2 was used. The intensity of pressurizing force and the temperature of heating were set as described in Table 1. In addition, in the pressure applying unit 9, the pressure applying member 92 was fixed and the toner image T on the recording medium P was pressurized by the pressure applying member 91.

(Measurement of Toner Surface Temperature)

The toner surface temperature of a whole solid image (toner coverage amount: 4 g/m$^2$) was measured with a non-contact thermometric sensor (sensor head: FT-H10, amplifier unit: FT-50A, both made of Keyence Co. Ltd.). In addition, when heating was not done in the pressure applying step (that is, when it is not a step of applying pressure to the toner image transferred on the recording medium while heating), the non-contact thermometric sensor was installed in the upstream position 241*a* of the pressure applying unit 9. When the step contains heating while applying pressure to the toner image on the recording medium, the non-contact thermometric sensor was installed in the downstream position 241*b* of the pressure applying unit 9 (refer to FIG. 2).

<Color Reproducibility>

An electrostatic latent image was developed on a plain paper (basis weight: 64 g/m$^2$) under the condition that the toner coverage amount was 4 g/m$^2$. The evaluation was done by using a print having a solid image (toner image) containing a toner layer on a surface of a paper and fixed by each fixing apparatus.

Black Image: Examples 1 to 9, Examples 13 to 16, and Comparative Example 1

An image density of each of the obtained solid patch fixed images was measured with a fluorescence spectrodensitometer "FD-7" (made by Konica Minolta, Inc.) at arbitral three points. An average density (image density) was determined. The evaluation was done according to the following criteria. When ranking is ○ or ◎, it means that there is no problem for practical use.

(Evaluation Criteria)

◎: Image density of 1.5 or more

○: Image density of 1.3 or more to less than 1.5

×: Image density of less than 1.3

(Color Image: Examples 10 to 12)

In order to compare the obtained solid patch fixed image with the solid patch fixed image that had each toner composition without light irradiation but fixed by subjecting to the heat-pressure treatment so that the toner surface temperature (241*b*) became 125° C., the color of the solid image portion of each sample was measured with a fluorescence spectrodensitometer "FD-7" (made by Konica Minolta, Inc.). The color difference was calculated by using CMC (2:1) color difference expression. The evaluation was done according to the following criteria. When ranking is ○ or ◎, it means that there is no problem for practical use.

(Evaluation Criteria)

◎: Color difference of less than 2

○: Color difference of 2 or more to less than 3.5

×: Color difference of 3.5 or more

<Fixability>

An electrostatic latent image was developed on a plain paper (basis weight: 64 g/m$^2$) under the condition that the toner coverage amount was 4 g/m$^2$. The evaluation was done by using a print having a solid image (toner image) containing a toner layer on a surface of a paper and fixed by each fixing apparatus.

An image of 1 cm square on this solid image was rubbed 10 times using a paper "JK Wiper (registered trade mark)" (made by Nippon Paper Crecia, Co, Ltd.) by giving a pressure of 10 kPa. The evaluation was made based on the fixing ratio of the image. A fixing ratio of 80% or more was regarded as acceptable.

The fixing ratio of the image is a value obtained by measuring the density of an image after printing and the density of the image after rubbing. The density was measured with a fluorescence spectrodensitometer "FD-7" (made by Konica Minolta, Inc.). The fixing ratio is a value represented in percentage that is calculated from the reflection density of the solid image after rubbing divided by the reflection density of the solid image after printing.

From the results in Table 1, it is possible to provide an image forming method enabling to produce a toner image fixed on a recording medium having an excellent color reproducibility and sufficient fixability even if the irradiation light has a short wavelength when the image forming method has a constitution of the present invention.

What is claimed is:

1. An image forming method comprising the steps of:

forming a toner image by developing an electrostatic latent image with a toner;

transferring the toner image on a recording medium; and fixing the toner image on the recording medium, wherein the fixing step of the toner image on the recording medium further contains the steps of:

irradiating only light having a wavelength range of 280 to 480 nm to the toner image; and applying pressure to the toner image, and the toner comprises a colorant and, in the toner, the colorant is a sole component capable of absorbing the light having the wavelength range of 280 to 480 nm.

2. The image forming method described in claim 1, wherein the toner image transferred on the recording medium is a black toner image or a color toner image formed with two or more color toners.

3. The image forming method described in claim 1, wherein, in the light irradiating step, the light has a wavelength range from 280 or more to less than 400 nm.

4. The image forming method described in claim 1, wherein, in the light irradiating step, the light has a maximum emission wavelength range from 280 or more to less than 400 nm.

5. The image forming method described in claim 1, wherein, in the light irradiating step, the light is irradiated with a light-emitting diode or a laser lighting source.

6. The image forming method described in claim 1, wherein, in the light irradiating step, a single or a plurality of lighting sources are used, and the light is irradiated to the toner image transferred on the recording medium from all of the lighting sources regardless a maximum absorption wavelength of the toner contained in the toner image.

7. The image forming method described in claim 1, wherein, in the light irradiating step, the light having a predetermined wavelength within the range is irradiated to the toner image regardless a maximum absorption wavelength of the toner contained in the toner image.

8. The image forming method described in claim 1, wherein, in the pressure applying step, the toner image transferred on the recording medium is pressed with a pressure in the range of 0.01 to 1.0 MPa.

9. The image forming method described in claim 1, wherein the toner contains a binder resin.

10. The image forming method described in claim 9, wherein the binder resin comprises a thermoplastic resin.

11. The image forming method described in claim 1, wherein the pressure applying step is a step of heating the toner image transferred on the recording medium while applying pressure to the toner image transferred on the recording medium.

12. The image forming method described in claim 11, wherein, in the step of heating while applying pressure, a surface temperature of the toner image is heated to a temperature of ($T_{g\text{-}min}$+20) ° C. or more, provided that $T_{g\text{-}min}$ is a glass transition temperature of the toner having a lowest glass transition temperature among the toner which forms the toner image.

13. An image forming apparatus employing the image forming method described in claim 1.

14. A toner image fixing apparatus used for the image forming apparatus described in claim 13, wherein the toner image fixing apparatus contains: a light irradiating unit to irradiate the toner image on the recording medium with only light in a wavelength range of 280 to 480 nm; and a pressure applying unit.

15. The image forming method described in claim 10, wherein the colorant is a sole component capable of converting the light into a heat to soften the thermoplastic resin.

* * * * *